US006805412B2

(12) United States Patent
Roth

(10) Patent No.: US 6,805,412 B2
(45) Date of Patent: Oct. 19, 2004

(54) STACKABLE CHAIR WITH FLEXIBLE BACK

(75) Inventor: Peter Simon Roth, Slough (GB)

(73) Assignee: Burgess Furniture Ltd., Feltham (GB)

( * ) Notice: Subject to any disclaimer, the term of this patent is extended or adjusted under 35 U.S.C. 154(b) by 0 days.

(21) Appl. No.: 10/231,711

(22) Filed: Aug. 30, 2002

(65) Prior Publication Data

US 2003/0047981 A1 Mar. 13, 2003

Related U.S. Application Data

(60) Provisional application No. 60/316,178, filed on Aug. 30, 2001.

(51) Int. Cl.[7] ..... A47C 7/02; A47C 5/04; A47C 1/12

(52) U.S. Cl. ..... 297/452.2; 297/239; 297/411.44; 297/445.1

(58) Field of Search ..... 297/452.2, 239, 297/411.44, 445.1

(56) References Cited

U.S. PATENT DOCUMENTS

| | | | | | |
|---|---|---|---|---|---|
| 2,063,781 | A | | 12/1936 | Ball | 155/50 |
| 2,163,078 | A | * | 6/1939 | Zerbee | 248/628 |
| D143,982 | S | | 2/1946 | Michelson | D6/334 |
| D163,655 | S | | 6/1951 | Virtue | D6/502 |
| 2,587,822 | A | | 3/1952 | Corning | 297/301.1 |
| 2,709,484 | A | * | 5/1955 | Lamb | 297/411.43 |
| 2,745,468 | A | | 5/1956 | Kramer | 155/53 |
| D178,505 | S | | 8/1956 | Duer | D6/334 |
| 2,802,514 | A | | 8/1957 | Ninde | 155/54 |
| D180,996 | S | | 9/1957 | Cramer | D15/1 |
| 2,835,317 | A | * | 5/1958 | Valtri | 248/440.1 |
| 2,942,654 | A | * | 6/1960 | Hamilton | 297/411.44 |
| 2,987,112 | A | | 6/1961 | Dorton | 155/162 |
| 3,102,733 | A | | 9/1963 | Burnett | 280/36 |

(List continued on next page.)

FOREIGN PATENT DOCUMENTS

| | | | | |
|---|---|---|---|---|
| AT | 89393 | | 9/1992 | 297/301.1 |
| DE | 415483 | | 6/1925 | 297/301.1 |
| FR | 2623701 | A1 * | 6/1989 | A47C/3/04 |
| IT | 257871 | | 3/1928 | 297/301.1 |

OTHER PUBLICATIONS

"Translation of French Patent Document No. 2,623,701," Apr. 22, 2003, U.S. patent and Trademark Office Translations Branch.*

English Translation of Abstract for French Patent Document No. 2,623,701.*

*Primary Examiner*—Peter M. Cuomo
*Assistant Examiner*—Sarah C. Burnham
(74) *Attorney, Agent, or Firm*—Gifford, Krass, Groh, Sprinkle, Anderson & Citkowski, PC

(57) ABSTRACT

A stacking chair includes a seat base with the seat cushion supported on the base and a seat back interconnected with the cushion and extending upwardly therefrom. The seat base includes a front member and a rear member. The front member includes a pair of front legs, a pair of generally horizontal lateral side portions interconnected with the front legs, and a transverse portion interconnecting the side portions at their rearmost ends. The rear member is an inverted U-shaped member defining a pair of rear legs and a transverse portion interconnecting the rear legs. The transverse portions of the front and rear members are interconnected so as to form the base.

28 Claims, 12 Drawing Sheets

U.S. PATENT DOCUMENTS 3,246,927 A * 4/1966 Klassen ..... 297/239
3,291,529 A 12/1966 Straits ..... 297/445
3,316,016 A * 4/1967 Petersen ..... 297/239
3,544,160 A 12/1970 Karasick ..... 297/354.1
3,788,586 A 1/1974 McNally ..... 248/373
3,973,798 A 8/1976 White ..... 297/296
3,982,785 A 9/1976 Ambasz ..... 297/160
4,032,190 A 6/1977 Muller-Deisig ..... 297/285
4,084,850 A 4/1978 Abmasz ..... 297/301.1
4,105,250 A * 8/1978 Caldwell ..... 297/448.1
D255,185 S 6/1980 Locher ..... D6/375
4,235,408 A 11/1980 Sapper ..... 248/608
4,333,683 A 6/1982 Ambasz ..... 297/301.1
4,431,157 A 2/1984 Arild ..... 248/583
4,549,764 A 10/1985 Haedo ..... 297/296
4,580,836 A 4/1986 Verney ..... 297/296
4,585,272 A 4/1986 Ballarini ..... 297/284
4,597,567 A 7/1986 Racca ..... 267/140.2
4,603,830 A 8/1986 Franck ..... 248/575
4,603,904 A 8/1986 Tolleson ..... 297/296
4,633,546 A 1/1987 Bergs ..... 16/277
4,666,121 A 5/1987 Choong et al. ..... 248/575
4,790,595 A 12/1988 Hensel et al. ..... 297/285
4,869,552 A 9/1989 Tolleson ..... 297/296
4,877,290 A 10/1989 Schetl ..... 297/270
4,889,385 A 12/1989 Chadwick et al. ..... 297/302
4,892,354 A 1/1990 Estkowski et al. ..... 297/301
4,911,501 A 3/1990 Decker et al. ..... 297/300
4,938,532 A 7/1990 Burgess ..... 297/301.3
4,943,114 A 7/1990 Piretti ..... 297/301
5,018,787 A 5/1991 Estkowski et al. ..... 297/302
5,024,484 A 6/1991 Buchacz ..... 297/300
5,024,485 A 6/1991 Berg et al. ..... 297/312
5,039,163 A 8/1991 Tolleson ..... 297/297
5,044,587 A 9/1991 Degen ..... 248/158
5,048,893 A 9/1991 Cowan et al. ..... 297/329
5,052,755 A * 10/1991 Wiener ..... 297/452.29
5,062,676 A 11/1991 Mars ..... 297/338
5,100,201 A 3/1992 Becker, III et al. ..... 297/300
5,114,210 A 5/1992 Naess ..... 297/300
5,123,702 A 6/1992 Caruso ..... 297/342
5,154,472 A 10/1992 Kaufman ..... 297/23
5,193,880 A 3/1993 Keusch et al. ..... 297/353
D335,041 S 4/1993 Meijer ..... D6/379
5,203,853 A 4/1993 Caruso ..... 297/303
D336,795 S 6/1993 Rowe et al. ..... D6/334
5,261,727 A 11/1993 Klaebel ..... 297/423.13
5,288,127 A 2/1994 Berg et al. ..... 297/312
5,320,410 A 6/1994 Faiks et al. ..... 297/296
D348,788 S * 7/1994 Starck
5,501,507 A 3/1996 Hummitzsch ..... 297/284.4
5,524,963 A 6/1996 Barile ..... 297/239
5,580,127 A 12/1996 Piretti ..... 297/301.3
5,681,085 A 10/1997 Nahoul ..... 297/302.4
5,697,673 A 12/1997 Favaretto ..... 297/301.1
5,704,688 A 1/1998 Schrewe et al. ..... 297/285
5,762,396 A * 6/1998 Barile ..... 297/239
D397,880 S 9/1998 Saul ..... D6/380
D401,769 S 12/1998 Kaiser ..... D6/334
5,868,468 A 2/1999 Wang ..... 297/320
5,871,256 A 2/1999 Kogai ..... 297/300.2
5,887,945 A 3/1999 Sedlack ..... 297/296
5,890,763 A 4/1999 Asbjornsen ..... 297/285
5,902,012 A 5/1999 Han ..... 297/285
5,904,397 A 5/1999 Fismen ..... 297/291
D410,802 S 6/1999 Olson ..... D6/379
5,931,531 A 8/1999 Assmann ..... 297/316
5,997,084 A 12/1999 Barile, Jr. et al. ..... 297/239
6,000,755 A 12/1999 Uhlenbrock ..... 297/300.2
6,019,429 A 2/2000 Tedesco ..... 297/328
D421,344 S 3/2000 Kaiser ..... D6/334
6,033,021 A 3/2000 Udo et al. ..... 297/313
6,050,642 A 4/2000 Erb ..... 297/322
6,056,361 A * 5/2000 Cvek ..... 297/300.2
6,065,803 A 5/2000 Li et al. ..... 297/301.3
6,099,076 A 8/2000 Nagel et al. ..... 297/337
D446,037 S 8/2001 Koepke et al. ..... D6/379
D449,459 S 10/2001 Diez Mintegi ..... D6/374
D454,442 S 3/2002 Hutton ..... D6/379
6,406,096 B1 6/2002 Barile, Sr. ..... 297/301.3
D470,317 S 2/2003 Roth ..... D6/334
D470,321 S 2/2003 Roth
6,533,352 B1 * 3/2003 Glass et al. ..... 297/299
2002/0053822 A1 * 5/2002 Ware et al. ..... 297/239

* cited by examiner

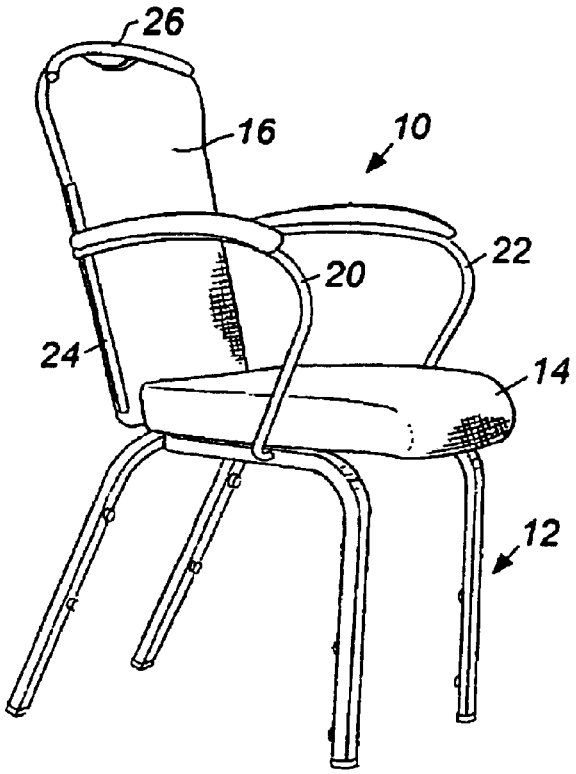
Fig - 1
Fig - 2
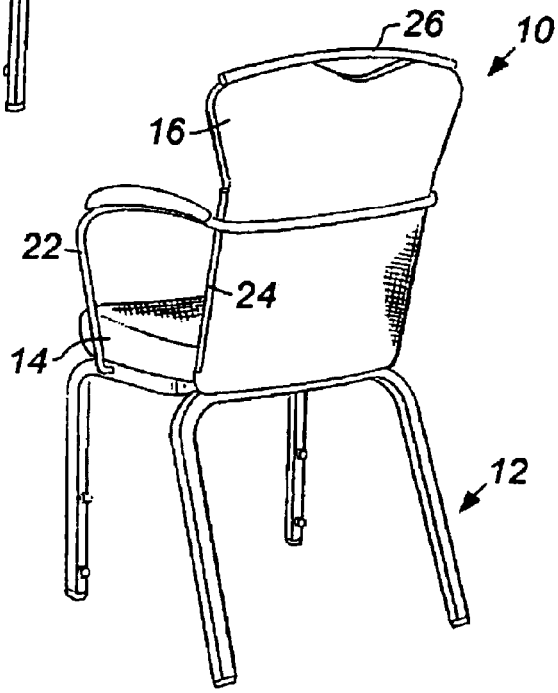
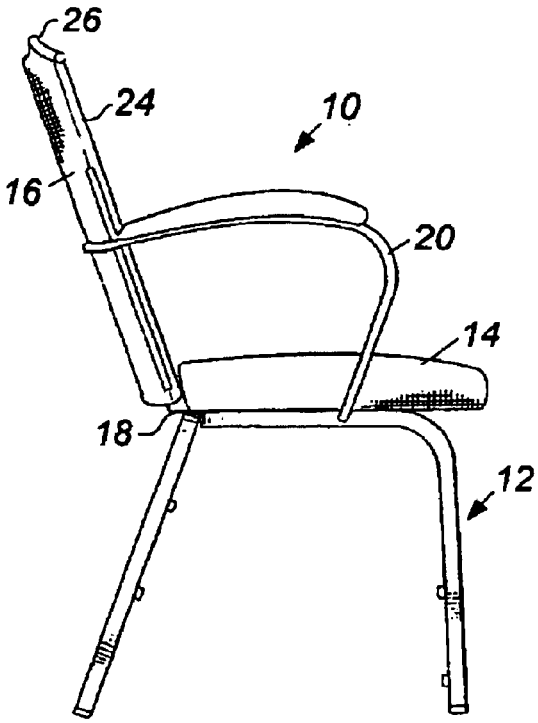
Fig - 3

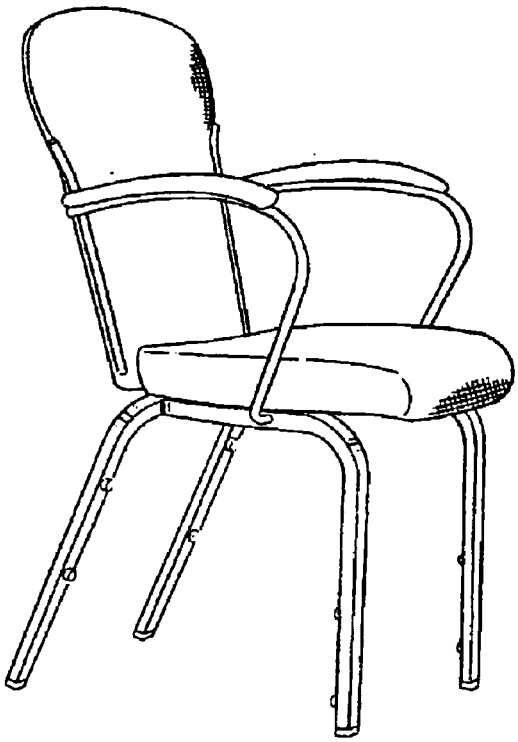
Fig - 7
Fig - 8
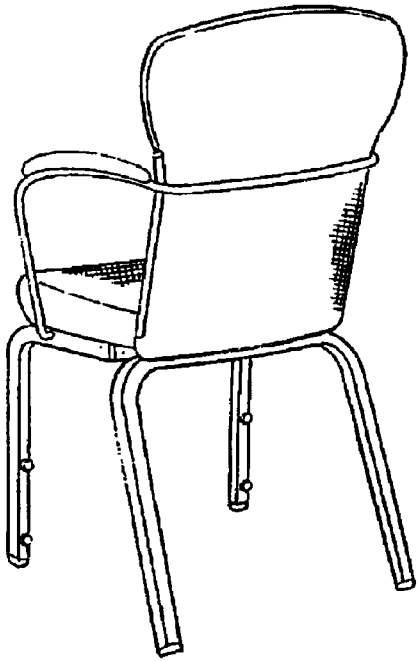
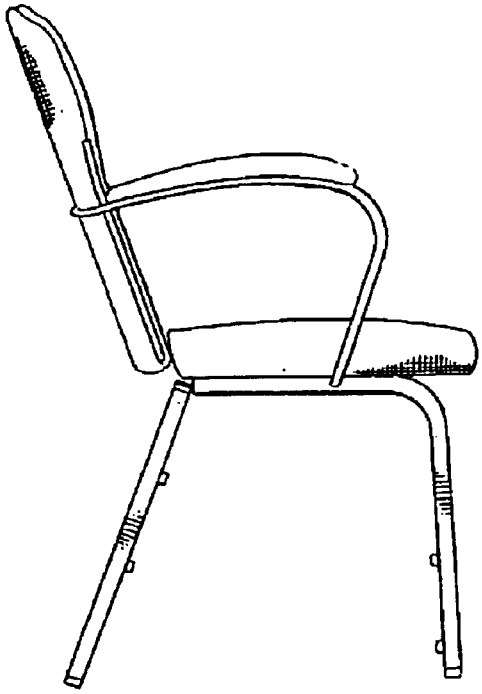
Fig - 9

STACKABLE CHAIR WITH FLEXIBLE BACK

REFERENCE TO RELATED APPLICATION

This application claims priority from U.S. provisional patent application Ser. No. 60/316,178, filed Aug. 30, 2001, the entire contents of which is incorporated herein.

FIELD OF THE INVENTION

The present invention relates generally to chairs, and more specifically to an improved stacking chair with an improved base.

BACKGROUND OF THE INVENTION

Chairs for extended seating applications, such as banquet halls and conference rooms, are preferably comfortable, durable, and either stackable or nestable for storage purposes. Traditional stackable banquet chairs include a pair of inverted-U-shaped leg members attached to opposite sides of a generally horizontal seat. A generally L-shaped back support frame interconnects with the leg members and extends upwardly from the rear of the seat to support a back cushion. This type of chair may be stacked by placing the inverted-U-shaped leg members of one chair over the top of the leg members of another chair, such that the seat of the upper chair is supported just above the seat of the lower chair. Examples of traditional stackable banquet chairs are shown in U.S. Pat. No. 3,102,733 to Burnett and U.S. Design Patent No. D180,996 to Cramer. While this type of chair has wide applicability, some property owners and interior designers prefer chairs that do not look like a traditional stacking chair. These traditional stacking chairs have the leg members completely exposed at the sides of the chairs. Some users prefer legs or leg members that are less visible.

The above-described chair is generally referred to as a stacking chair, because the leg members of one chair rest directly on the leg members of a lower chair creating a secure leg-on-leg stack. Multiple chairs may be securely stacked on top one another with this design.

An alternative to stacking chairs is so-called nesting chairs. Nesting chairs come in a variety of styles and are distinguished from stacking chairs in that the underside of a seat frame of one chair rests atop the seat cushion of a lower chair when the chairs are nested. An example of a nesting chair, as defined herein, is illustrated in U.S. Pat. No. 5,524,963 to Barile. This design of chair nests or stacks much less securely, since an upper chair is supported by the flexible cushion of the lower chair. Seat cushions are also vulnerable to excessive wear and tear as chairs are nested and unnested. An advantage with nesting chair designs is that the chair designer may configure the chair legs to be less exposed than with traditional stacking chairs. However, this benefit is significantly compromised by the fact that nesting chairs typically cannot be stacked as high or as securely, and that the seat cushions are prone to damage. In light of the above, there remains a need for improved stacking chairs with chair legs that have a non-traditional look and design. Because chairs for extended seating applications are often used for extended periods of time, seating designers are continuously seeking ways to improve the comfort of the chairs. It is preferred that the seat back flex somewhat with respect to the seat cushion to improve comfort. However, providing a flexible seat back presents significant challenges to seat designers, especially where the chair must also stack or nest.

Examples of stacking or nesting chairs with seat backs that flex relative to the seat bottom are shown in the following U.S. Pat. No. 4,549,764 to Haedo; U.S. Pat. Nos. 4,603,904, 4,869,559, and 5,039,163 to Tolleson; U.S. Pat. No. 4,938,532 to Burgess; and U.S. Pat. No. 5,902,012 to Han. The designs disclosed in these patents are generally complicated and costly to manufacture, limiting their applicability. Also, the designs are generally limited to stacking chairs wherein the legs of the chairs are completely exposed.

SUMMARY OF THE INVENTION

The present invention improves on the prior art by providing a chair that stacks securely with the legs of an upper chair being supported by the legs of a lower chair. At the same time, the present invention provides a chair wherein the portions of the seat base interconnecting the legs of the chair may be less exposed than with traditional stacking chairs. In addition, some embodiments of the present invention provide a seat back that will flex with respect to the seat cushion for improved comfort. Some embodiments also include armrests.

One embodiment of a stacking chair according to the present invention includes a seat cushion having a front edge, a rear edge, and opposed right and left side edges. The chair also includes a seat base that supports a seat cushion in a generally horizontal position. The seat base has a front member and a rear member. The front member includes a front right leg and a front left leg each having lower ends for contacting a support surface and upper ends spaced therefrom. The front member also includes a right lateral portion and a left lateral portion. The right lateral portion has a forward end interconnected with the upper end of the front right leg and extends generally horizontally rearwardly adjacent the right side edge of the seat cushion to a rearward end. The left lateral portion has a forward end interconnected with the upper end of the front left leg and extends generally horizontally rearwardly adjacent the left side edge of the seat cushion to a rearward end. The right and left lateral portions are disposed inboard of the side edges of the seat cushion along the majority of their length. The front member also includes a transverse portion that extends between and interconnects the rearward ends of the right and left lateral portions. The rear member includes a rear right leg and a rear left leg each having lower ends for contacting a support surface and upper ends spaced therefrom. The rear member also includes a transverse portion extending between and interconnecting the upper ends of the right and left rear legs. The transverse portion of the rear member is disposed adjacent the rear edge of the seat cushion and generally parallel to the transverse portion of the front member. The transverse portions of the front member and the rear member are interconnected so as to form the base.

BRIEF DESCRIPTION OF THE DRAWINGS

FIG. 1 is a perspective view of a first embodiment of a chair according to the present invention;

FIG. 2 is a rear perspective view of the chair of FIG. 1;

FIG. 3 is a side elevational view of the chair of FIGS. 1 and 2;

FIG. 7 is a front perspective view of a third embodiment of a chair according to the present invention;

FIG. 8 is a rear perspective view of the chair of FIG. 7;

FIG. 9 is a side elevational view of the chair of FIGS. 7 and 8;

DETAILED DESCRIPTION OF THE PREFERRED EMBODIMENTS

Figure 4:
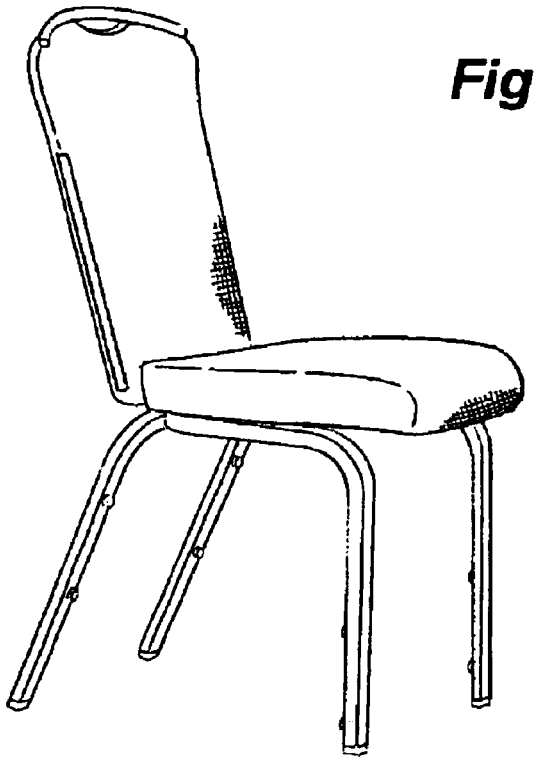
FIG. 4 is a perspective view of a second embodiment of a chair according to the present invention.
Figure 5:
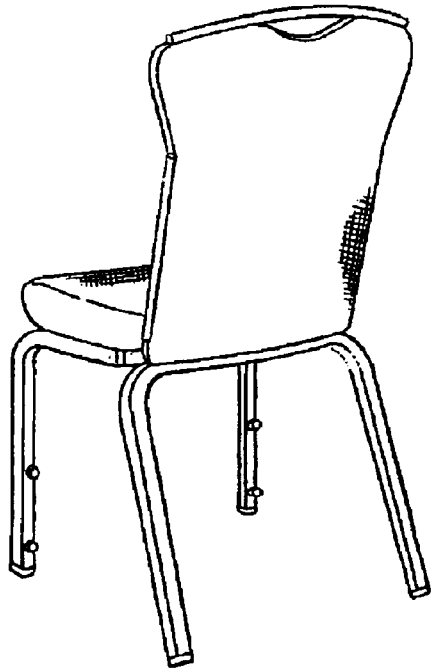
FIG. 5 is a rear perspective view of the chair of FIG. 4.
Figure 6:
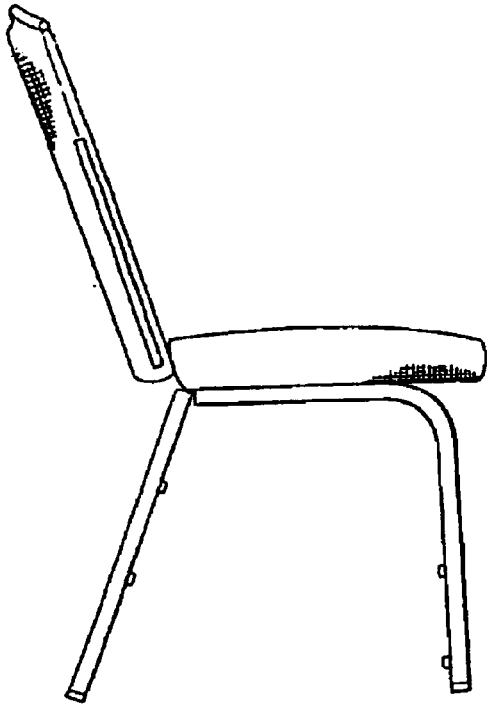
FIG. 6 is a side elevational view of the chair of FIGS. 4 and 5.
Figure 10:
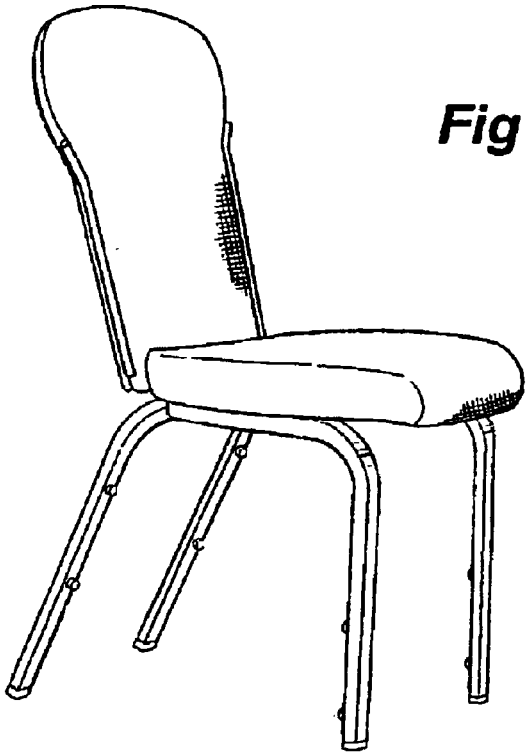
FIG. 10 is a front perspective view of a fourth embodiment of a chair according to the present invention.
Figure 11:
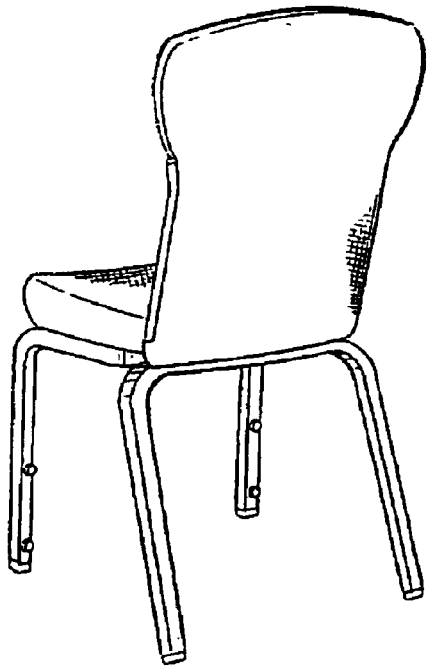
FIG. 11 is a rear perspective view of the chair of FIG. 10.
Figure 12:
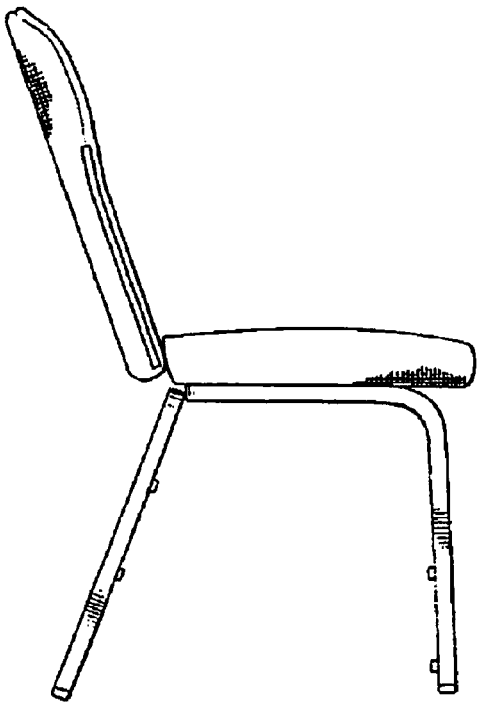
FIG. 12 is a side elevational view of the chair of FIGS. 10 and 11.
Figure 19:
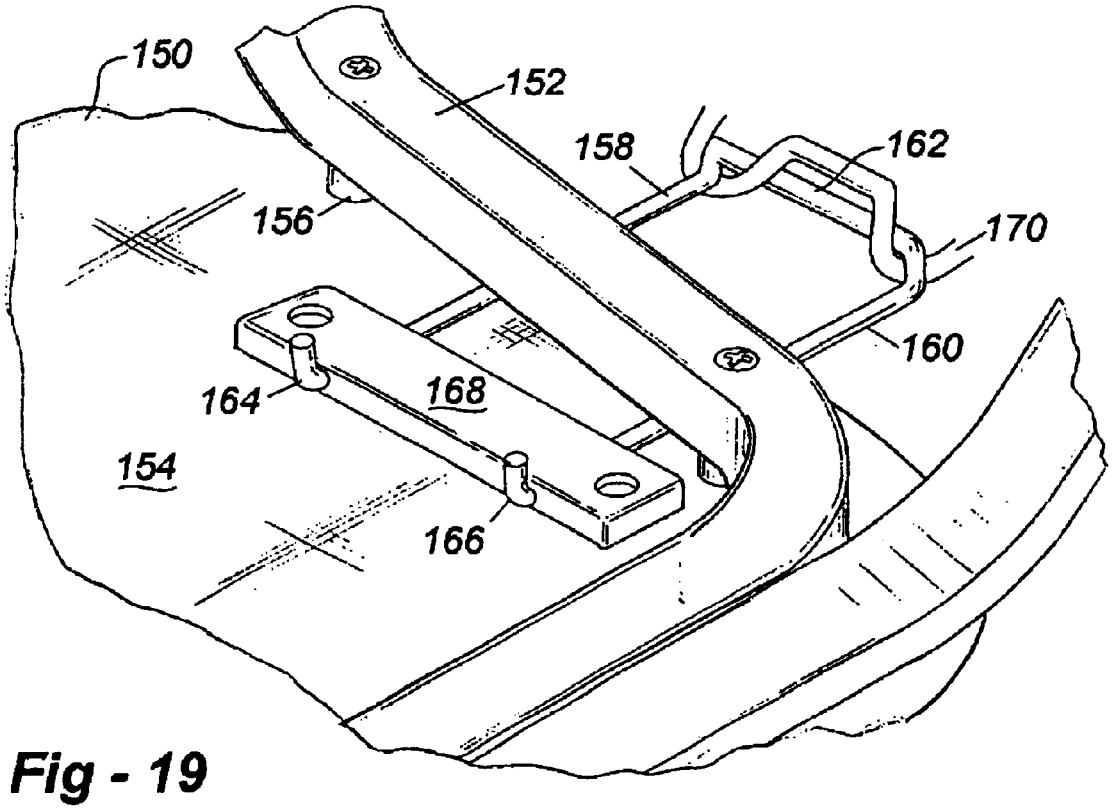
FIG. 19 is a detailed view of a portion of the underside of a chair according to the present invention, including a retractable ganging device.
Figure 20:
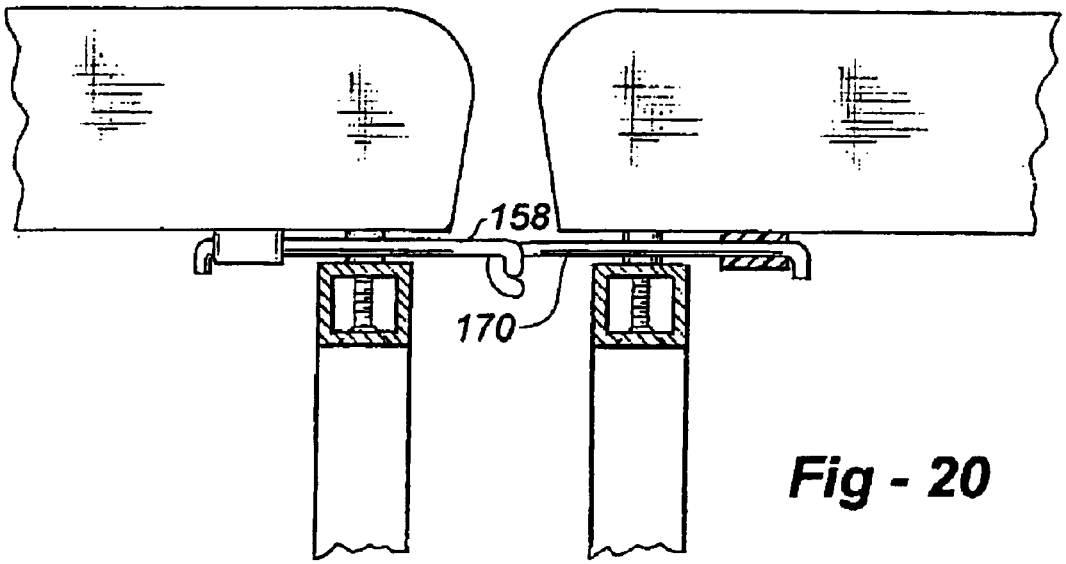
FIG. 20 is a cross-sectional front view of a portion of two chairs according to the present invention, positioned side-by-side, and interconnected using the ganging device of FIG. 19.

FIGS. 1–3 show a first embodiment of a chair according to the present invention. FIGS. 4–6 show a second embodiment of a chair, similar to FIGS. 1–3, but without arms on the chair. FIGS. 7–9 show a third embodiment of a chair according to the present invention. FIGS. 10–12 show a fourth embodiment of a chair according to the present invention, that is similar to FIGS. 7–9, but without arms on the chair. FIGS. 13–18 show various views of the frame preferably used on the chairs in the prior figures. FIGS. 19 and 20 illustrate a ganging device for use with the various embodiments of the present invention. FIGS. 21–24 illustrate a fifth embodiment of a chair according to the present invention, and FIGS. 25–28 illustrate a sixth embodiment of a chair according to the present invention.

As will be clear to those of skill in the art, the various embodiments of the present invention shown in FIGS. 1–12 are similar in overall appearance and structure. Therefore, in the present specification, only the embodiment of FIGS. 1–3 will be described in detail. The chair 10 includes a base 12 that supports a seat cushion 14 in a generally horizontal position. A seat back 16 extends generally upwardly from the rear edge of the seat cushion 14. The seat back 16 is preferably interconnected with the seat cushion 14 by a back support member or seat bracket 18. Alternatively, the support member 18 may be connected to the base 12. The back support member 18 is preferably a flexible piece of metal that allows the seat back 16 to flex somewhat relative to the seat cushion 14. In the illustrated embodiment, the chair 10 also includes a pair of armrests 20 and 22. The armrests 20 and 22 are preferably formed by a single armrest member that extends from the base below the seat cushion 14, upwardly and rearwardly to define one armrest, across behind the seat back 16 to interconnect with the seat back, then forwardly and downwardly to define the other armrest, and finally interconnecting with the base on the other side of the seat cushion. The armrests 20 and 22 are preferably sufficiently flexible such that the chair back 16 can flex. The ends of the armrest member, where they join the base 12, may be slightly rotatable to allow unhindered flexing of the back 16. Armrest cushions may be provided on the armrest member. FIGS. 4–6 show a chair similar to chair 10, but with the armrests removed.

The seat back 16 may have a pair of protective side members 24 for protecting the sides of the seat back from wear and tear. The side members 24 may be metal, plastic or other materials. A hand grip member 26 may be provided on the upper end of the seat back 16 for providing an attractive appearance, protecting the top of the seat back 16, and providing a place where the chair may be grasped.

FIGS. 4–6 show an embodiment of the chair that is very similar to the embodiment of FIGS. 1–3. The only difference between the first embodiment shown in FIGS. 1–3 and the second embodiment of FIGS. 4–6 is that the second embodiment lacks armrests. FIGS. 7–9 illustrate a third embodiment of the present invention. This embodiment is again similar to the embodiment of FIGS. 1–3 and the embodiment of FIGS. 4–6. However, the embodiment of FIGS. 7–9 has a somewhat different back shape and lacks the hand grip member of the earlier embodiments. The version of the chair shown in FIGS. 7–9 includes armrests, as previously described. FIGS. 9–12 illustrate a fourth embodiment of the present invention which is substantially identical to the embodiment of FIGS. 7–9, but without armrests.

Figure 13:
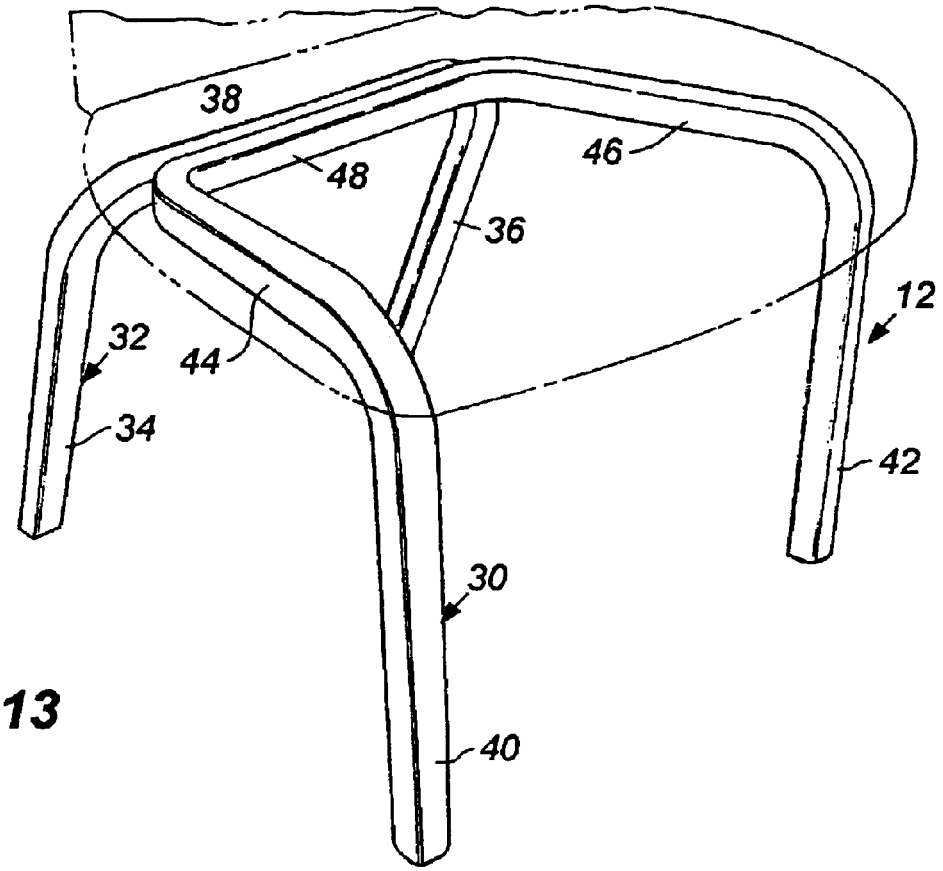
FIG. 13 is a perspective view of a chair base according to the present invention.
Figure 14:
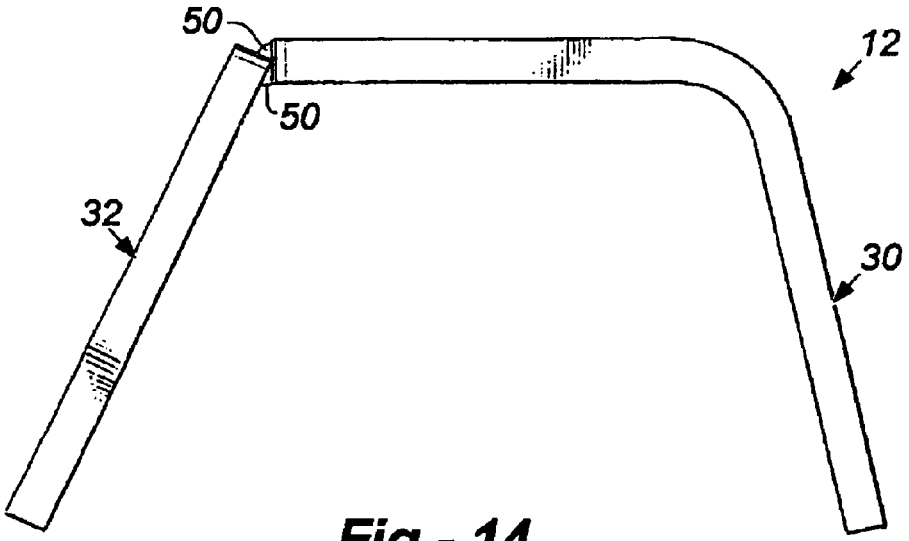
FIG. 14 is a side elevational view of the chair base of FIG. 13.
Figure 15:
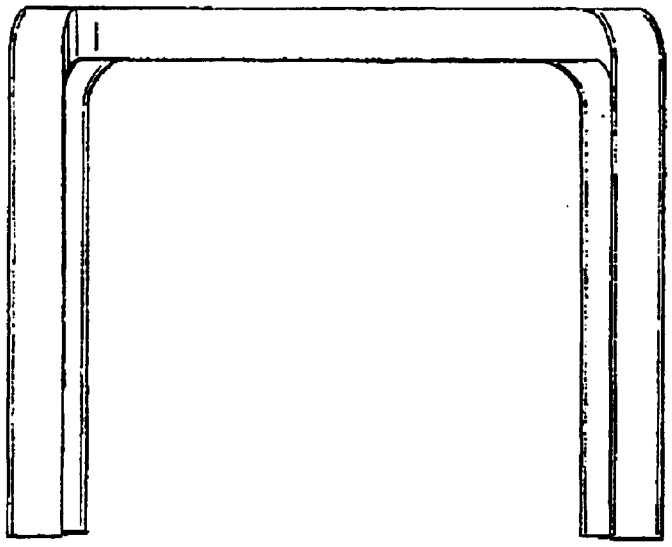
FIG. 15 is a front elevational view of the chair base of FIGS. 13 and 14.
Figure 16:
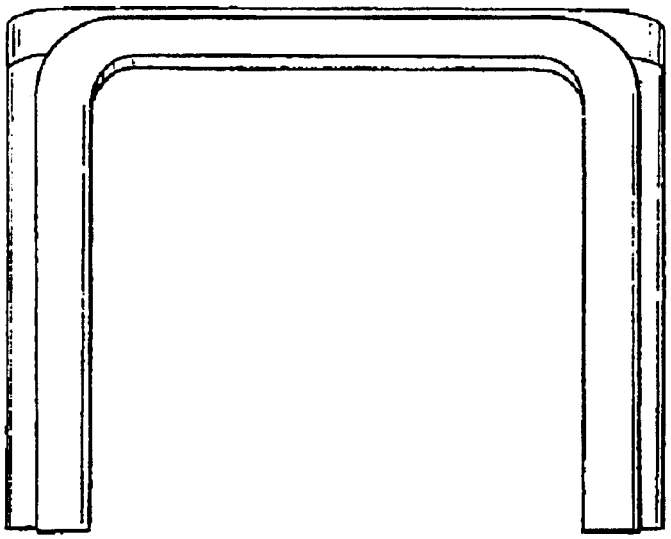
FIG. 16 is a rear elevational view of the chair base of FIGS. 13–15.
Figure 18:
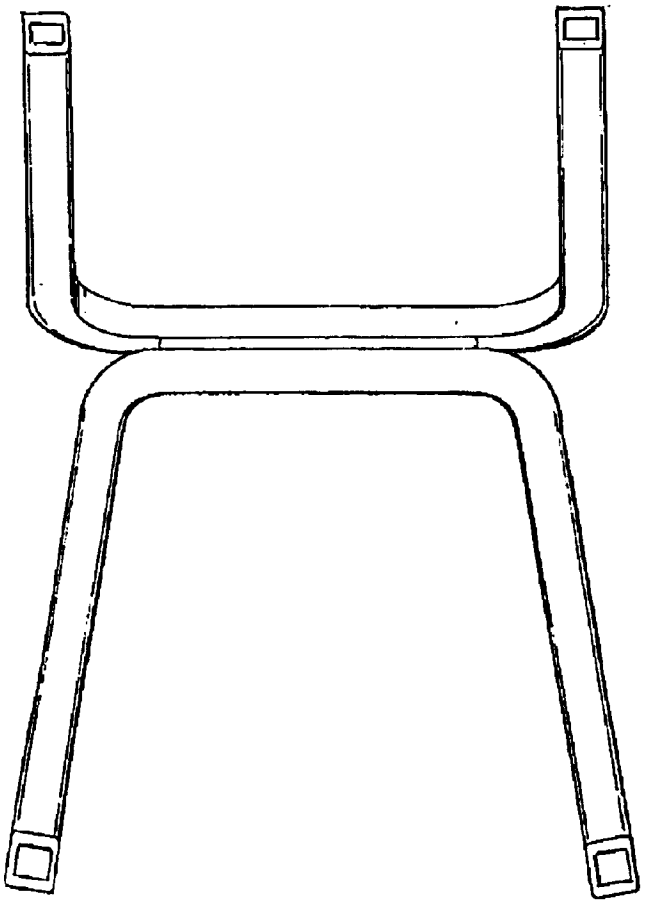
FIG. 18 is a bottom plan view of the chair base of FIGS. 13–17.
Figure 17:
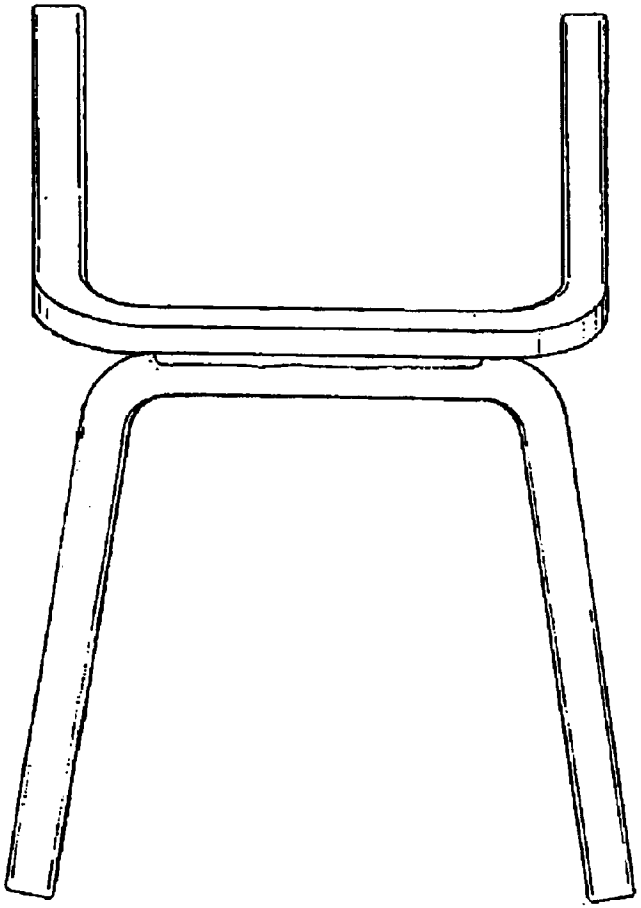
FIG. 17 is a plan view of the chair base of FIGS. 13–16.

Referring now to FIGS. 13 and 14, the base 12 will be described in more detail. The base 12 provides significant advantages and, by itself, is one embodiment of the present invention. The base may be used with a chair upper other than those shown and described in the present specification. Alternatively, the chair uppers may be used with other base designs, if so desired.

The base 12 includes a front member 30 and a rear member 32 that together form the entire base 12. The rear member 32 is basically an inverted U-shaped member that is positioned side-to-side such that it defines both rear legs 34 and 36 with an interconnecting generally horizontal transverse portion 38. The rear member 32 is positioned such that the transverse portion 38 is near to the rear end of the seat cushion of the assembled chair. The rear member is preferably a single bent piece of tubing formed such that the rear leg 34 extends generally vertically upwardly and then bends inwardly or inboard to form the transverse portion 38, and then downwardly to form the other leg 36.

The front member 30 is more complexly shaped. It includes a pair of front legs 40 and 42, a pair of generally horizontal lateral side portions 44 and 46, and a generally horizontal transverse member 48. The front member is preferably is a single bent piece of tubing formed such that front leg 40 extends generally vertically upwardly and then bends rearwardly to form side portion 44. The front member 30 then bends inwardly or inboard to form a transverse portion 48, forwardly to form the other side portion 46 and then downwardly to form the other generally vertical front leg 42. The front member 30 and rear member 32 are joined to one another by interconnecting their transverse portions 38 and 48, which are preferably parallel. These two portions are preferably welded to one another. The tubes forming the front and rear portions may be somewhat deformed at the area where they connect in order to provide a better weld. For example, either the front or rear member may be distorted so as to provide more of a flat surface where they interconnect. In FIG. 14, the interconnection between the two members is shown not to share a flat surface, but instead is interconnected by weld beads 50. An interconnecting or adapting piece may also be provided to improve the interconnection.

A seat cushion may be supported on the side portions 44 and 46 and the transverse portions 38 and 48. As will be clear to those of skill in the art, the base provides significant structure adjacent to the rearmost edge of the seat cushion. This allows easy interconnection with a seat back since the base 12 has significant structure very near where the seat back joins the seat cushion and base. Also, as will be clear to those of skill in the art, the base 12 allows for secure stacking of chairs one atop another. The base is designed such that one base may be rested on top of another with secure leg-on-leg contact. However, the side members 44 and 46 are positioned inboard of the sides of the seat cushion, so as to give an improved appearance.

FIGS. 15, 16, 17 and 18 provide front, rear, top and bottom views, respectively, of the base of FIGS. 13 and 14. These views help to illustrate the relative positioning of the front and rear members and their relative dimensions.

Figure 21:
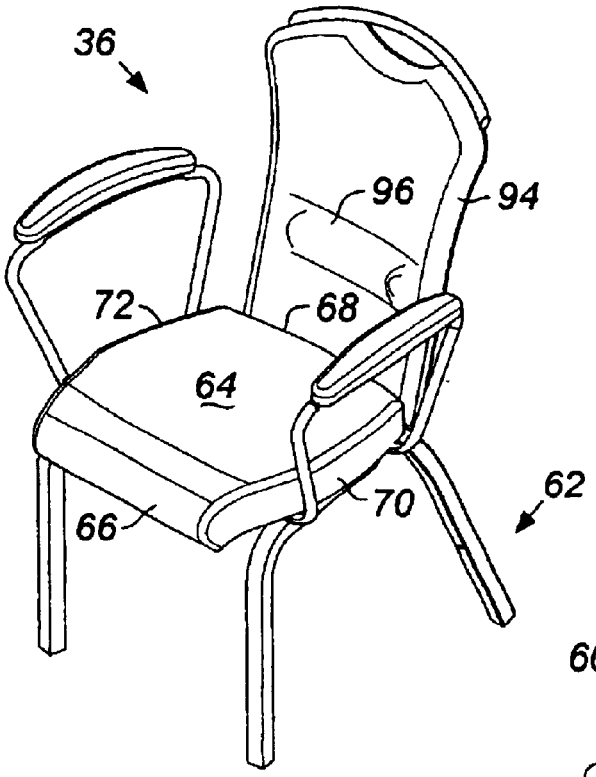
FIG. 21 is a front perspective view of a fifth embodiment of a chair according to the present invention.
Figure 22:
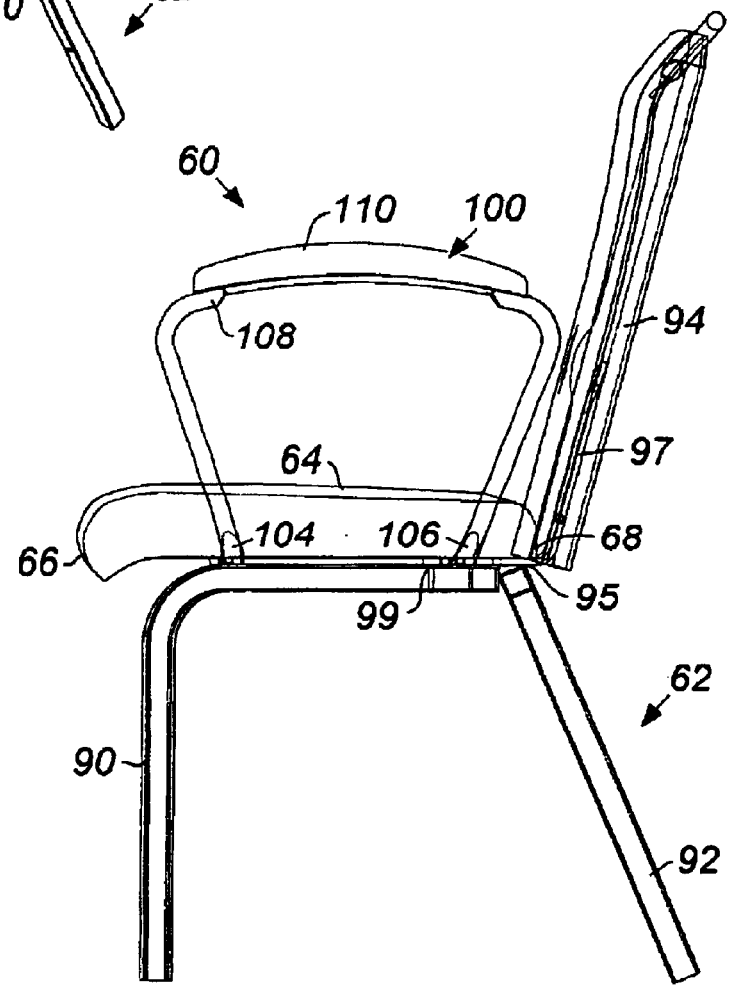
FIG. 22 is a side-elevational view of the chair of FIG. 21, with the chair being shown as partially transparent so as to show details thereof.
Figure 23:
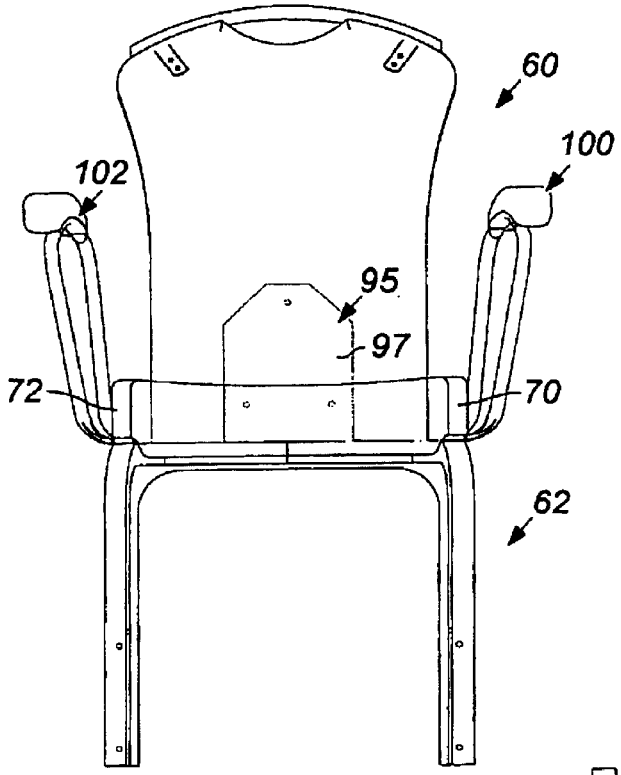
FIG. 23 is a front elevational view of the chair of FIGS. 21 and 22, also in partial transparency.
Figure 24:
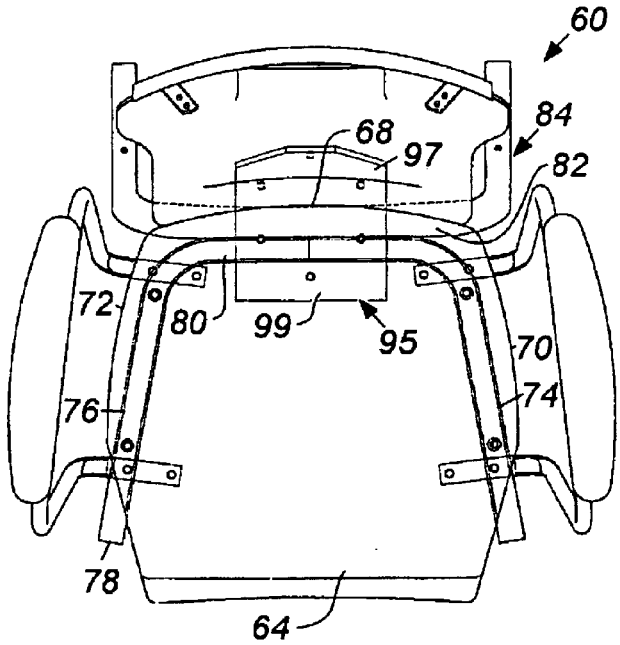
FIG. 24 is a top plan view of the chair of FIGS. 21–23, also in partial transparency.
Figure 25:
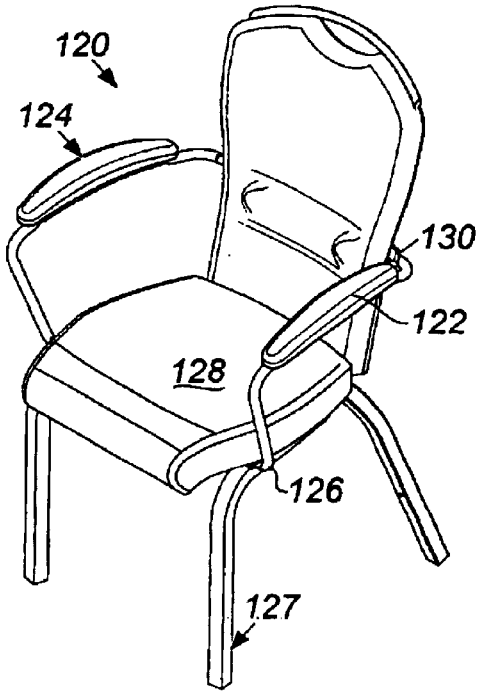
FIG. 25 is a front perspective view of a sixth embodiment of a chair according to the present invention.
Figure 26:
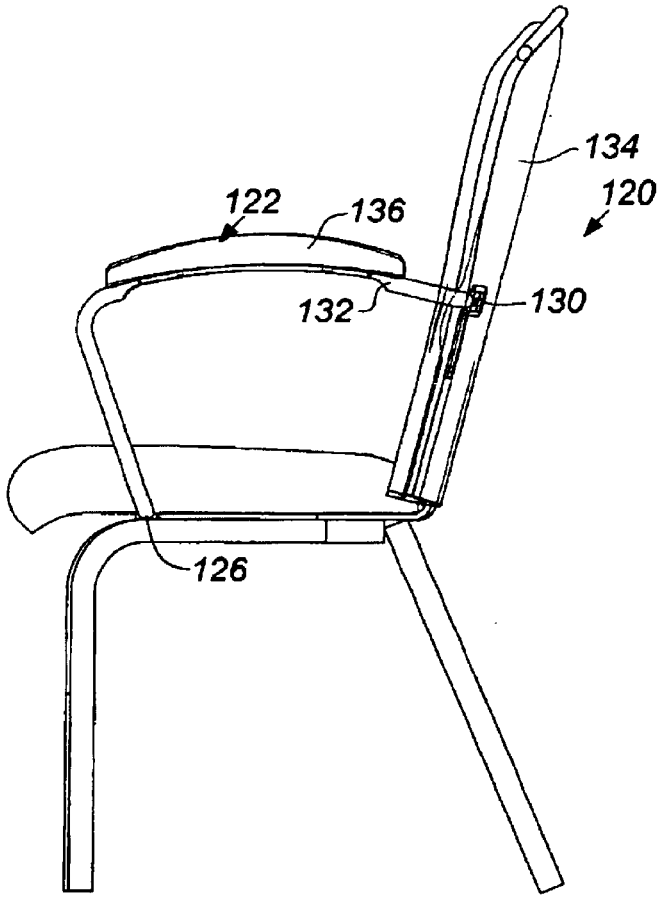
FIG. 26 is a side elevational view of the chair in FIG. 25, shown as partially transparent.
Figure 27:
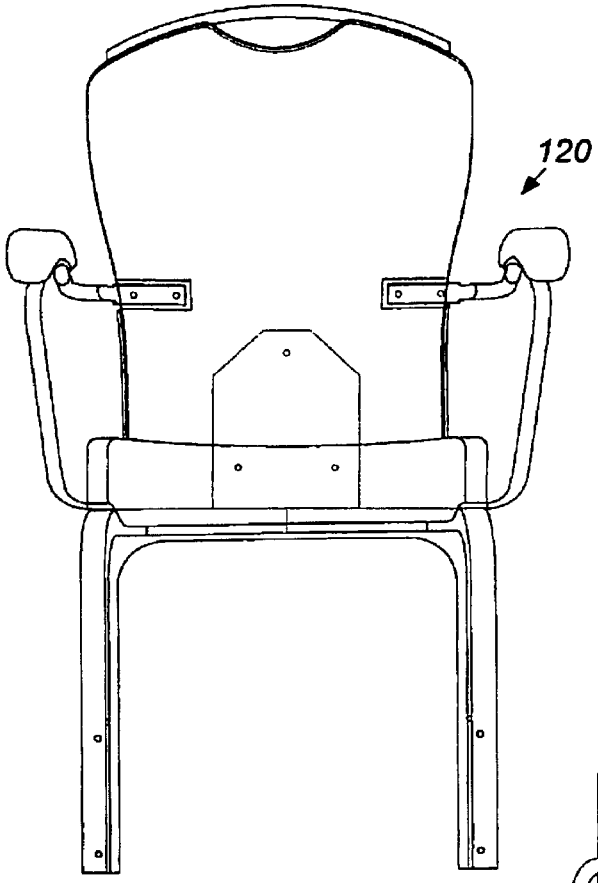
FIG. 27 is a front elevational view of the chair in FIGS. 25 and 26, also shown as partially transparent.
Figure 28:
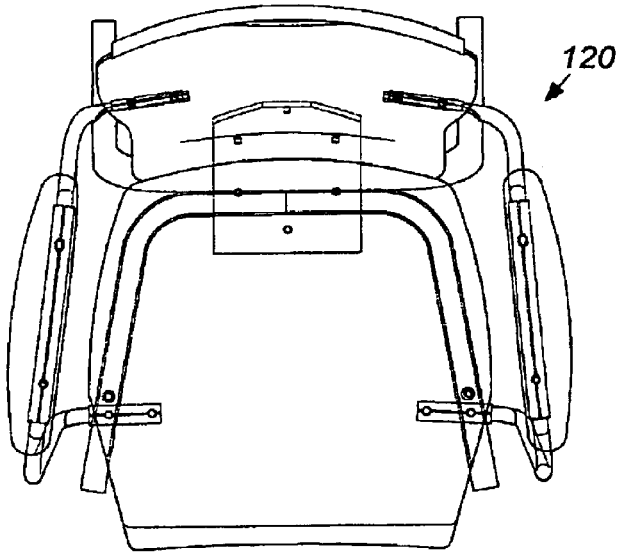
FIG. 28 is a top plan view of the chair of FIGS. 25–27, also shown as partially transparent.

Referring now to FIGS. 21–24, a fifth embodiment of a chair according to the present invention is generally shown at 60. The chair 60 includes a base 62 of the same design as previously discussed. A seat cushion 64 is supporting on the base in a generally horizontal position. The seat cushion 64 may be said to have a front edge 66, a rear edge 68 and an opposed left edge 70 and right edge 72. FIGS. 22–24 are shown with various components being partially transparent so as to show details of the chair construction. As best shown in FIG. 24, the lateral side portions 74 and 76 and the front member 78 extend rearwardly adjacent the side edges 70 and 72 of the seat cushion 64. Also as shown, the right and left lateral side portions 74 and 76 are disposed inboard of the side edges 70 and 72 of the seat cushion along the majority of their length. This contributes to the aesthetically pleasing appearance of the chair according to the present invention. Alternatively, the lateral side members may be positioned more outwardly, or may even be positioned so as to be outboard of the side edges 70 and 72 of the cushions. However, the illustrated positioning is preferred. FIG. 24 also illustrates that the transverse portion 80 of the front member 78 and the transverse portion 82 of the rear member 84 extend parallel to one another and are adjacent the rear edge of the seat cushion 64. The transverse portions 80 and 82 are also in generally parallel alignment along the majority of the distance between the edges 70 and 72 of the seat cushion 64. This relatively long co-extension of the transverse portions provides a substantial area for a weld bead or other interconnection between the members 78 and 84. Preferably, the transverse portions 80 and 82 are interconnected by welding along the majority of their length.

As also shown in FIG. 24, the lateral side portions 74 and 76 generally angle outwardly as they extend from the rear of the chair to the front of the chair. As shown in FIG. 22, the front legs 90 may extend approximately straight downwardly. Alternatively, they may bend slightly rearwardly, or slightly or significantly forwardly. The rear legs 92 angle significantly rearwardly as they extend downwardly from the seat cushion 64. Here again, other angles are possible. By reviewing the various figures, those of skill in the art will appreciate that the chairs of the present invention will stack on like chairs in a secure leg-on-leg stack. However, significant portions of the base are disposed inboard of the perimeter of the seat cushion so as to give a pleasing aesthetic appearance.

Referring again to FIG. 21, a seat back 94 as shown extending generally upwardly from the back of the chair. The seat back 94 preferably has a lumbar support bolster 96. While it is illustrated in hard lines to show one preferred outline, the bolster on an upholstered seat back according to the present invention is preferably less apparent than as illustrated in FIG. 21.

FIGS. 22–24 also illustrate a bracket 95 which is used to interconnect the seat cushion 64 with the seat back 94. As shown, the seat bracket 95 is generally L-shaped with the upper leg 97 of the L-shaped bracket attached to the seat back 94 and the lower leg 99 of the seat bracket attached to the seat cushion 64 such as by bolting or screwing. The seat bracket has a side-to-side width less than the width of the seat cushion or seat back, but sufficiently large to securely support the seat back. In addition, in some embodiments, the seat bracket is preferably sufficiently flexible to allow the seat back to flex rearwardly when an occupant leans back. However, the bracket is sufficiently resilient that the seat back returns to its normal position when the occupant stops pushing back. This design provides for a significantly less complicated flex-back design than much of the prior art. This design of bracket may be used with any of the embodiments of the present invention.

Referring to FIGS. 22 and 23, the armrests 100 and 102 will be described in more detail. Unlike in previous embodiments, the armrests 100 and 102 are attached only to the base 62 or seat cushion 64 and not to the seat back 94. Armrest 100 may be said to have a first end 104 and a second end 106, both connected to the base 62 or cushion 64. From the first and second ends 104 and 106, the armrest 100 may be said to extend upwardly to a generally horizontal central portion 108, such that the armrest takes the form of an inverted U. An armrest cushion 110 may be attached to the generally horizontal central portion 108. In the illustrated embodiment, the armrest 100 is formed out of round tubing that is flattened in the central portion 108, and at the first and second ends 104 and 106. The armrest 102 is formed as a mirror image of the armrest 100. This armrest design may also be used with the embodiments of the present invention illustrated in FIGS. 1–12.

Referring now to FIGS. 25–28, a sixth embodiment of a chair according to the present invention is generally shown at 120. This embodiment is substantially the same as the embodiment of FIGS. 21–24, but has a different armrest design. The chair 120 has left and right armrests 122 and 124. The armrest 122 may be said to have a first end 126 interconnected with the base 127 or the seat cushion 128. The armrest 122 has a second end 130 interconnected with the seat back. Again, the armrest may be formed out of round tubing with flattened ends and a flattened central portion 132. As shown, the armrest 122 extends upwardly from the first end 126 to the generally horizontal central portion 132, which extends rearwardly to the second end 130, which is connected to the seat back 134. Again, a cushion 136 may be provided. As shown, the second end 130 of the armrest 122 differs from the design of the armrest interconnection shown in FIGS. 1–3 and 7–9, where the armrest was formed as a tube that extended entirely across the rear of the seat back.

The sixth embodiment of the chair also has a bracket interconnecting the seat back with the seat cushion. However, in this embodiment, it is preferred that the seat back flex less than in the previous embodiment. The armrests which interconnect between the seat cushion and seat back help to stiffen the seat back and reduce flex. Alternatively or additionally, the seat bracket may be made stiffer.

Referring now to FIGS. 19 and 20, a ganging device for use with the chairs of the present invention will be described. In many applications, it is desirable to interconnect a plurality of like chairs in a substantially aligned row. For this purpose, a variety of ganging devices have been developed. However, many ganging devices, when not in use, provide an undesirable aesthetic appearance. FIGS. 19 and 20 illustrate a ganging device for use with the present invention. FIG. 19 illustrates a portion of the underside of a chair 150, including a portion of the front member 152. Preferably, small spacers 156 are provided between the upper side of the member 152 and the underside of the cushion 154. A ganging device is shown at 158. It includes a loop of metal wire 160 with a central portion 162 that extends out from the side of the chair 150 and a pair of ends 164 and 166 that extend inwardly and interconnect with the chair 150. In the preferred embodiment, the ends 164 and 166 slideably engage in a ganger support 168 which is attached to the underside of the seat cushion 154. The ganger 158 is shown with the loop 160 in an extended position. Alternatively, when the ganger is not in use, the loop 160 may be pushed inwardly such that the ends 164 and 166 slide with respect to the support 168 until the loop is flush with the side of the chair. FIG. 19 also illustrates a portion of a corresponding ganging device 170 which interconnects with the loop 160. FIG. 20 illustrates the ganging device 158 interconnected with the ganging device 170. Preferably, both may be retracted when not in use.

As will be clear to those of skill in the art, the hereindescribed embodiments of the present invention may be altered in various ways without departing from the scope or teaching of the present invention. It is the following claims, including all equivalents, which define the scope of the present invention.

I claim:

1. A stacking chair comprising:

a seat base including a front member unitarily formed from a continuous piece of tubing and a rear member unitarily formed from a second continuous piece of tubing, the front member comprising a pair of front legs, a pair of generally horizontal lateral side portions interconnected with the front legs, and a transverse portion interconnecting the side portions at their rearmost ends, the rear member comprising an inverted-U-shaped member defining a pair of rear legs and a transverse portion interconnecting the rear legs, the transverse portions of the front and rear members being generally parallel and interconnected so as to form the base;

a seat cushion supported on said base, the seat cushion generally defining a horizontal plane, the front and rear members of the seat base each being entirely disposed below the horizontal plane; and a seat back being interconnected with said cushion and extending upwardly therefrom.

2. A stacking chair comprising:

a seat base including a front member and a rear member, the front member comprising a pair of front legs, a pair of generally horizontal lateral side portions interconnected with the front legs, and a transverse portion interconnecting the side portions at their rearmost ends, the rear member comprising an inverted-U-shaped member defining a pair of rear legs and a transverse portion interconnecting the rear legs, the transverse portions of the front and rear members abutting and interconnected so as to form the base;

a seat cushion supported on said base;

a seat back; and a seat bracket interconnected with a rear edge of the seat cushion and a lower edge of the seat back, the seat bracket being sufficiently flexible such that the seat back may flex with respect to the seat cushion when leaned on.

3. The stacking chair according to claim 1, wherein the seat cushion has a front edge, a rear edge, and opposed right and left side edges, the lateral side portions of the front member being spaced inwardly from respective side edges of the seat cushion along a majority of their length.

4. A stacking chair comprising:

a seat base including a front member and a rear member, the front member comprising a pair of front legs, a pair of generally horizontal lateral side portions interconnected with the front legs, and a transverse portion interconnecting the side portions at their rearmost ends, the front legs, side portions and transverse portion being unitarily formed from a continuous piece of tubing, the rear member comprising an inverted-U-shaped member defining a pair of rear legs and a transverse portion interconnecting the rear legs, the rear legs and transverse portion being unitarily formed from a second continuous piece of tubing;

a seat cushion supported on said base;

the transverse portions of the front and rear members abutting and interconnected so as to form the base; and a seat back being interconnected with said cushion and extending upwardly therefrom.

5. The stacking chair according to claim 1, wherein the seat cushion has a front edge, a rear edge, and opposed right and left side edges, the transverse portions of the front and rear members extending in generally parallel alignment the majority of the distance between the right and left side edges of the cushion.

6. A stacking chair comprising:

a seat cushion having a front edge, a rear edge, and opposed right and left side edges; and a seat base supporting the seat cushion in a generally horizontal position, the seat base having a front member and a rear member, the front member including:

a front right leg and a front left leg each having lower ends for contacting a support surface and upper ends spaced therefrom;

a right lateral portion and a left lateral portion, the right lateral portion having a forward end interconnected with the upper end of the front right leg and extending generally horizontally rearwardly adjacent the right side edge of the seat cushion to a rearward end, the left lateral portion having a forward end interconnected with the upper end of the front left leg and extending generally horizontally rearwardly adjacent the left side edge of the seat cushion to a rearward end, the right and left lateral portions having outer edges spaced inwardly from the side edges of the seat cushion along the majority of their length; and a transverse portion extending between and interconnecting the rearward ends of the right and left lateral portions;

the rear member including:

a rear right leg and a rear left leg each having lower ends for contacting a support surface and upper ends spaced therefrom; and a transverse portion extending between and interconnecting the upper ends of the right and left rear legs, the transverse portion of the rear member being disposed adjacent the rear edge of the seat cushion; and the transverse portions of the front member and the rear member abutting and being interconnected so as to form the base.

7. The stacking chair according to claim 6, further comprising a seat bracket interconnected with the rear edge of the seat cushion and a seat back having a lower edge interconnected with the seat bracket.

8. The stacking chair according to claim 7, further comprising a right and a left armrest member, each armrest member having a first end and a second end both interconnected with one of the lateral portions of the front member, the armrest member extending upwardly from the first and second ends to a generally horizontal central portion, the seat bracket being sufficiently flexible such that the seat back will flex rearwardly when leaned against.

9. The stacking chair according to claim 7, further comprising a right and a left armrest member, each armrest member having a first end interconnected with one of the lateral portions of the front member and a second end interconnected with the seat back, each armrest member extending upwardly from the first end to a generally horizontal portion which extends rearwardly to the second end.

10. The stacking chair according to claim 6, wherein the front member of the base is unitarily formed from a continuous piece of tubing and the rear member is unitarily formed from a second continuous piece of tubing.

11. The stacking chair according to claim 6, wherein the transverse portions of the front and rear members both extend in generally parallel alignment the majority of the distance between the right and left side edges of the cushion.

12. The stacking chair according to claim 11, wherein the transverse portions are interconnected along a majority of their length by welding.

13. A stacking chair comprising:

a seat cushion having a front edge, a rear edge, and opposed right and left side edges; and a seat base supporting the seat cushion in a generally horizontal position, the seat base having a front member and a rear member, the front member being a unitary piece formed from a continuous piece of tubing, the front member having a first end defining a lower end of a front right leg, the front member extending upwardly from the first end so as to define the front right leg and then bending rearwardly to define a generally horizontal lateral side portion, the front member then bending inboard and extending transversely to define a generally horizontal transverse portion, the front member then bending forwardly and extending forwardly to define a second generally horizontal lateral portion, the front member then bending downwardly and extending downwardly to the second end to define a front left leg, the rear member being a unitary piece formed from another continuous piece of tubing, the rear member having a first end defining a lower end of a rear right leg, the rear member extending upwardly from the first end so as to define the rear right leg and then bending inboard and extending transversely to define a generally horizontal transverse portion, the rear member then bending downwardly and extending downwardly to the second end so as to define a rear left leg, the transverse portions of the front and rear members abutting and being interconnected so as to form the base.

14. The stacking chair according to claim 13, further comprising a seat bracket interconnected with the rear edge of the seat cushion and a seat back having a lower edge interconnected with the seat bracket.

15. The stacking chair according to claim 14, further comprising a right and a left armrest member, each armrest member having a first end and a second end both interconnected with one of the lateral portions of the front member, the armrest member extending upwardly from the first and second ends to a generally horizontal central portion, the seat bracket being sufficiently flexible such that the seat back will flex rearwardly when leaned against.

16. The stacking chair according to claim 13, further comprising a right and a left armrest member, each armrest member having a first end interconnected with one of the lateral portions of the front member and a second end interconnected with the seat back, each armrest member extending upwardly from the first end to a generally horizontal portion which extends rearwardly to the second end.

17. The stacking chair according to claim 13, wherein the transverse portions of the front and rear members are interconnected along a majority of their length by welding.

18. The stacking chair according to claim 1, further comprising a seat bracket interconnected with a rear edge of the seat cushion and a lower edge of the seat back, the seat bracket being sufficiently flexible such that the seat back may flex with respect to the seat cushion when leaned on.

19. The stacking chair according to claim 1, further comprising a right and a left armrest member, each armrest member having a first end and a second end both interconnected with one of the lateral portions of the front member, the armrest member extending upwardly from the first and second ends to a generally horizontal central portion.

20. The stacking chair according to claim 1, further comprising a right and a left armrest member, each armrest member having a first end interconnected with one of the lateral portions of the front member and a second end interconnected with the seat back, each armrest member extending upwardly from the first end to a generally horizontal portion which extends rearwardly to the second end.

21. The stacking chair according to claim 2, wherein the seat cushion has a front edge, a rear edge, and opposed right and left side edges, the lateral side portions of the front member being disposed inboard of the side edges of the seat cushion along a majority of their length.

22. The stacking chair according to claim 2, wherein the seat cushion has a front edge, a rear edge, and opposed right and left side edges, the transverse portions of the front and rear members extending in generally parallel alignment the majority of the distance between the right and left side edges of the cushion.

23. The stacking chair according to claim 2, wherein the front member of the base is unitarily formed from a continuous piece of tubing and the rear member is unitarily formed from a second continuous piece of tubing.

24. The stacking chair according to claim 2, further comprising a right and a left armrest member, each armrest member having a first end and a second end both interconnected with one of the lateral portions of the front member, the armrest member extending upwardly from the first and second ends to a generally horizontal central portion.

25. The stacking chair according to claim 2, further comprising a right and a left armrest member, each armrest member having a first end interconnected with one of the lateral portions of the front member and a second end interconnected with the seat back, each armrest member extending upwardly from the first end to a generally horizontal portion which extends rearwardly to the second end.

26. The stacking chair according to claim 4, wherein the seat cushion has a front edge, a rear edge, and opposed right and left side edges, the lateral side portions of the front member being disposed inboard of the side edges of the seat cushion along a majority of their length.

27. The stacking chair according to claim 4, further comprising a right and a left armrest member, each armrest member having a first end and a second end both interconnected with one of the lateral portions of the front member, the armrest member extending upwardly from the first and second ends to a generally horizontal central portion.

28. The stacking chair according to claim 4, further comprising a right and a left armrest member, each armrest member having a first end interconnected with one of the lateral portions of the front member and a second end interconnected with the seat back, each armrest member extending upwardly from the first end to a generally horizontal portion which extends rearwardly to the second end.

* * * * *